United States Patent [19]

Kriegel

[11] Patent Number: 4,467,570

[45] Date of Patent: Aug. 28, 1984

[54] GUTTER GUARD AND LOCKING CLIP THEREFOR

[75] Inventor: Harry F. Kriegel, Warren, N.J.

[73] Assignee: Royal-Apex Manufacturing Co. Inc., Plainfield, N.J.

[21] Appl. No.: 285,017

[22] Filed: Jul. 20, 1981

[51] Int. Cl.[3] ..... E04D 13/00

[52] U.S. Cl. ..... 52/12; 210/162

[58] Field of Search ..... 52/11, 12; 210/154, 210/162, 163, 473, 474, 479; 24/333, 259 R, 252 R; 292/137, 145, 147, 149; 248/48.1

[56] References Cited

U.S. PATENT DOCUMENTS

| | | | |
|---|---|---|---|
| 2,288,121 | 6/1942 | Cisar et al. | 52/12 |
| 2,636,458 | 4/1953 | Harris | 52/12 X |
| 2,810,173 | 10/1957 | Bearden | 248/48.1 |
| 3,053,393 | 9/1962 | Mclean | 52/12 X |
| 4,307,976 | 12/1981 | Butler | 52/11 X |

*Primary Examiner*—John E. Murtagh
*Assistant Examiner*—Michael Safavi
*Attorney, Agent, or Firm*—Schwartz, Jeffery, Schwaab, Mack, Blumenthal & Koch

[57] ABSTRACT

A gutter guard and locking snap clip for the guard for use with rain gutters in order to prevent leaves and other debris from clogging the outlet of the gutter. The gutter guard is formed with louvre type slots to permit rain to pass therethrough to said gutter for runoff but prevent leaves or other debris from passing through the guard. The guard in one form of the invention is formed with at least one guide groove adjacent the forward edge of the guard. The guide groove is located in a plane below the plane of the adjoining surfaces of said guard and the clip can be moved through the groove. The clip is formed adjacent its leading end with at least one surface irregularity above or below the plane of said leading end, which is adapted to be engaged by or be positioned behind a reversely bent flange of the gutter return bead so as to removably lock the clip, and thus the guard, to the gutter. In another form of the invention, the guard is formed with spaced tongues which function similarly to the separate clips in accordance with other forms of the invention.

9 Claims, 15 Drawing Figures

GUTTER GUARD AND LOCKING CLIP THEREFOR

BACKGROUND OF THE INVENTION

The present invention relates as indicated to a gutter guard and locking clip therefor, and more particularly to a unique gutter guard and integral or separately constructed locking clip for retaining the gutter guard on a conventional rain gutter.

Gutter guards are well known in the art and serve the useful purpose of preventing leaves and other debris from entering the gutter and thereby possibly clogging the gutter outlet at the downflow pipe. Presently known gutter guards of this general type normally comprise foraminous members which cover the entire top of the gutter, with various types of screening material being commonly employed. The foraminous material permits rain to pass downwardly therethrough but not leaves and other debris, which simply collect on the top of the gutter guard and obstruct the surface drainage. Moreover, there is a tendency in certain gutter guards made of wire mesh or expanded metal to have the leaves cling to the surface of the guard thereby rendering them useless for rain drainage.

Since present gutter guards or screens as they are also referred to, are relatively light in weight due to the foraminous nature of the same, they are subject to being blown off the top of the gutter. Although it is known in the art to provide means for clamping the gutter guard to the gutter return beads, these have not proven satisfactory in use. In one form, the gutter guard is formed with a metal edging on its leading or forward edge which coacts with the gutter return bead for retaining the gutter guard in place. However, experiences to date have indicated that such form of retention does not provide a secure holding of the guard since no locking device is used. In another known arrangement, a separate hinged clip is provided with the guard, with the clip coacting with the gutter bead for retaining the gutter guard in position. However, such clip is very cumbersome to apply since it must be placed in proper position while the installer employs both hands while standing on a ladder. Moreover, the clip adds to the installation costs.

SUMMARY OF THE INVENTION

With the above in mind, a principal feature of the present invention is the provision of a novel gutter guard construction. The guard is formed with louvre-type slots through which rain can pass to the gutter, with the guard otherwise providing a solid surface on which leaves and other debris can accumulate rather than passing into the gutter. The rear edge of the gutter is adapted to rest on a gutter support brace, and the leading edge of the gutter is formed with downwardly depending flanges which extend downwardly adjacent the rear edge of the gutter return bead of the gutter, thereby spacing the gutter guards front to rear on the gutter. Except at the location of the flanges, the leading edge of the gutter guard extends over the gutter return bead. Thus, the flanges can be struck from the forward edge of the gutter guard as desired to accommodate various size gutters.

The gutter guard is formed with at least one, and preferably a plurality of longitudinally spaced guide grooves located adjacent the leading edges of the guard. These grooves are constructed and arranged so as to receive locking snap clips, which are formed with projections or depressions in the surface thereof. In certain forms of the invention, projections extend upwardly from the plane of the leading edge of the clip, and in other forms grooves or depressions are formed in the legs of the clip. In either event, insertion of the clip through the groove serves to engage the projection or depression with the bottom edge of the reversely bent flange of the gutter return bead. The shapes of the clip and the guide groove are such that the leading edge of the clip is cammed downwardly whereby resilient pressure inherent in the configuration of the clip serves to bias the depression into engagement with the bottom surface of the return flange, or position a projection behind such return flange. Preferably, a series of projections or depressions are formed in the clip so as to accommodate various gutter shapes and dimensions. In each instance, the clip is removably locked in place, and in the event it is desired to remove the gutter guard from its locked position, the clip can be engaged by suitable releasing means, such as a screw driver, or separately provided release key, to permit the clip to be removed for unlocking the gutter guard.

In a further form of the invention, the gutter guard is integrally formed with at least one downwardly extending tongue having an upwardly extending flange at the forward end thereof which is adapted to extend behind the return bead of the gutter when the gutter guard is installed. In this form of the invention, a separate clip thus need not be provided.

These and other objects of the invention will become apparent as the following description proceeds in particular reference to the application drawings.

BRIEF DESCRIPTION OF THE APPLICATION DRAWINGS

FIG. 5 is a sectional view taken on line 15—15 of FIG. 14.

DETAILED DESCRIPTION OF THF PREFERRED EMBODIMENTS

Figure 13:
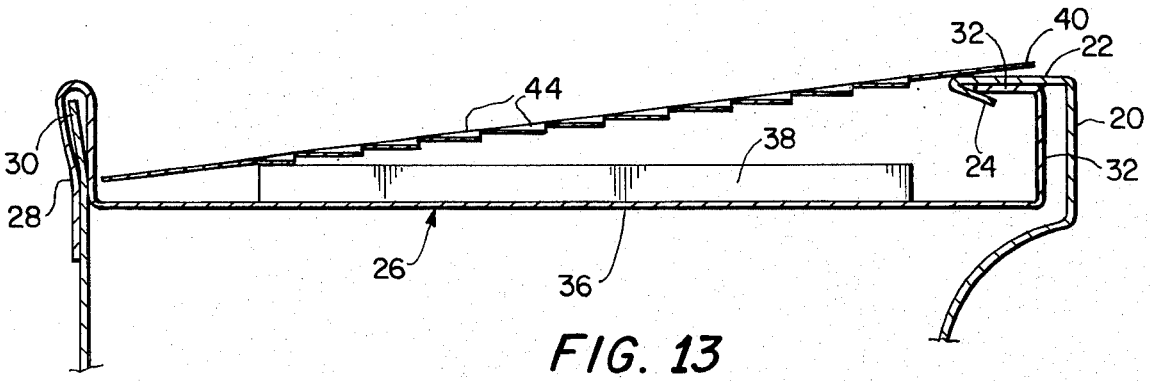
FIG. 13 illustrates the manner in which the FIG. 12 form of the invention is removably locked in place.

Referring now in more detail to the application drawings, wherein like parts are indicated by like reference numerals, the gutter guard constructed in accordance with the present invention is generally indicated at 10, and is adapted to be associated with a rain gutter generally indicated at 12. The gutter 12 is of conventional construction, comprising a bottom wall 14, back wall 16 and a front wall 18. The front wall 18 includes a bottom vertical flange 20 and a forwardly offset forward vertical flange 19, separated by a generally reversely curved intermediate portion. The flange 20 forms part of the gutter return bead, which also includes a top, horizontally extending flange 22 and a reversely bent flange or bead 24, best seen in FIG. 13. Gutter support braces generally indicated at 26, FIG. 13, are also normally provided with the gutter, with the brace including an inverted U-shaped retaining flange 28 at the rear end thereof which extends over the top edge of the back wall 16 of the gutter, and a leading edge portion which includes a vertically extending flange 32 and an obliquely directed and reversely bent end flange 34 which extends into the recess formed by the top flange 22 and the bead 24 of the gutter. The brace further includes an intermediate portion 36 which can be formed with upwardly directed ribs 38 at the sides thereof for rigidifying the brace members. In a typical installation, the brace members 26 are positioned at spaced intervals along the gutter and serve to rigidify the gutter and maintain the spacing of the front and back walls. It will be noted in this regard that where the gutter is constructed of metal, it is of relatively thin guage, with the support braces serving to prevent bending of the front walls of the gutter.

Figure 1:
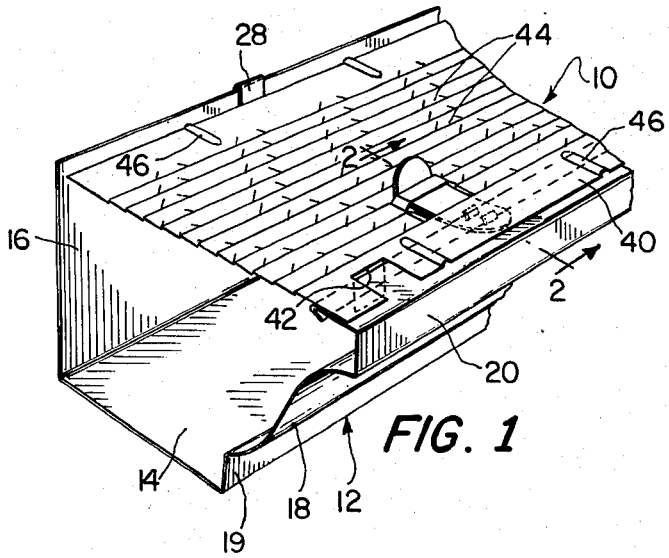
FIG. 1 is a fragmentary perspective view showing the gutter guard and one form of locking snap clip in accordance with the present invention, with the guard being shown locked to the gutter return bead of the gutter.

The gutter guard 10 is supported along its rear edge by the gutter support braces, and at its forward or leading edge 40 by the top flange 22 of the gutter return bead, with the leading edge 40 overlapping the flange 22. A series of downwardly depending detents 42, only one of which is visible in FIG. 1, are struck from the leading edge of the gutter guard and depend downwardly adjacent the rearwardmost portion of the gutter return bead for spacing the gutter guard from front to rear. It will be understood that the length of the detent 42 can be varied depending upon the dimension of the gutter as measured from the rear wall 16 to the rearward most surface of the gutter return bead so as to space the gutter guard on the gutter with minimum play in a front to rear direction.

The guard 10 is provided with numerous louvre-type slots commonly designated at 44 formed throughout the length and width of the guard, with the slots being formed by stamping during the manufacture of the guard. The slots 44 serve the purpose of permitting rain to fall downwardly through the guard but are sufficiently small in dimension so as to prevent leaves and debris from passing through the guard to the gutter. If desired, rigidifying ribs commonly designated at 46 can be formed in the trailing and leading edges of the guard to rigidify and stiffen the construction of the guard.

In the invention thus far described, the gutter guard 10 can be quickly and easily supported on the gutter, being supported at the rear edge thereof by the support braces 26, with the leading edge 40 being supported by the return bead flange, with the detents 42 serving to quicky and easily orient and space the guard on the gutter.

Figure 3:
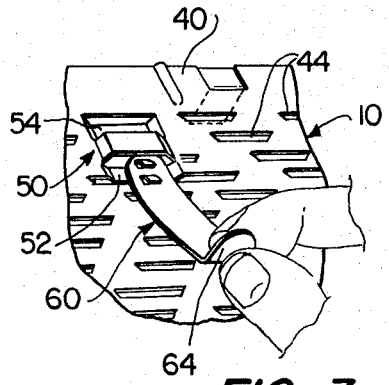
FIGS. 3 and 4 illustrate the manner in which one of the locking snap clip embodiments is inserted through a groove formed in the gutter guard.
Figure 4:
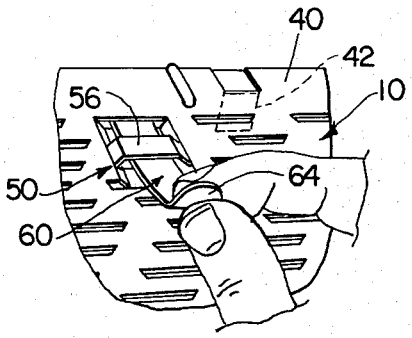
Figure 5:
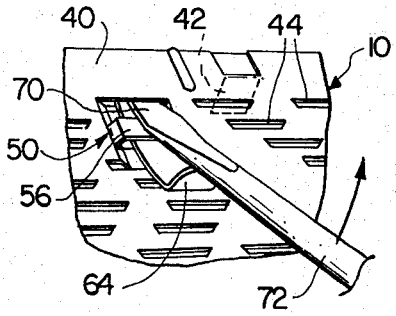
FIG. 5 illustrates one method by which the releasable locking clip can be removed from engagement with the gutter return bead thereby freeing the gutter guard.

As best seen in FIGS. 3–5, the gutter guard is formed with longitudinally spaced guide slots generally indicated at 50 relatively adjacent the leading edge of the guard. Each slot includes downwardly offset portions 52 and 54 which are in a plane below the plane of the guard, and a raised portion 56 struck upwardly from the plane of the guard. The depressed portions 52 and 54 and the raised portion 56 thus define an opening of substantial vertical extent through which a locking snap clip generally indicated at 60 can be inserted for retaining the guard on the gutter, as will be presently described. The depressed portions 52 and 54 and the raised portion 56 can likewise be formed during the stamping operation.

Figure 6:
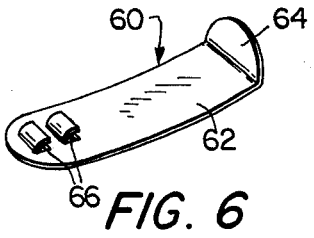
FIGS. 6–11 show various modifications of locking snap clips constructed in accordance with the present invention.

FIGS. 6–11 illustrate several different types of separate locking snap clips which can be employed in connection with the present invention. Referring to FIG. 6, which illustrates the clip appearing in FIGS. 1–5, the clip includes a body portion 62 and an upwardly turned finger flange 64 which can be grasped during insertion and removal of the clip. Toward the leading edge of the clip, two projections commonly designated at 66 are struck upwardly from the body 62, at an oblique angle relative thereto. The width of the body portion 62 is slightly less than the width of the guide slot 50 formed in the gutter guard, and the length of the clip is such as to permit one of the detents 66 to be engaged behind the return flange 24 of the gutter return bead of the gutter.

Figure 2:
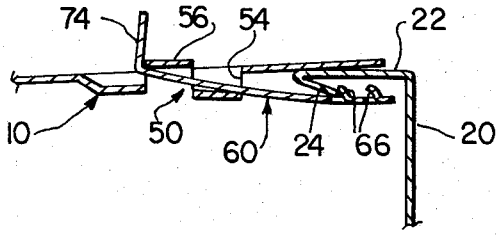
FIG. 2 is a sectional view taken on line 2—2 of FIG. 1.

FIGS. 3 and 4 show the procedure for inserting the clip shown in FIG. 6, and FIG. 2 comprises a cross-sectional view showing the clip in its installed position. Referring to FIG. 3, the clip is positioned with its leading edge below the raised portion 56 of the guide slots, and continued movement of the clip causes the leading edge thereof to approach the reversely bent flange or bead 24 of the gutter return bead of the gutter. As the leading edge approaches the reversely bent bead 24, the clip is cammed downwardly so that the forward projection passes under the bottom edge of the bead and, with continued movement of the clip, the second projection 66 is cammed beneath such edge, as appears in FIG. 2. At this point, the finger flange 64 is positioned closely adjacent the upraised portion 56 of the guide slot.

The clip 60 is formed of a resilient metal material, for example, relatively thin sheet metal, whereby the downward distortion of the same during the described forward movement through the guide slot results in a resilient biasing of the clip upwardly whereby the body of the clip tightly engages the bottom edge of the bead, with the projection 66 being positioned behind the bead. Thus, until the clip is intentionally removed as will be hereinafter described, it serves to removably lock the gutter guard to the gutter thereby preventing inadvertent removal of the guard by wind or other environmental or extraneous conditions.

It will be understood that a series of guide slots are provided along the length of the gutter guard, which can be supplied in incremental lengths, for example, four feet. Although only one guide slot and clip is sufficient for retaining the gutter guard in place on the gutter, a plurality of clips serves to more firmly retain the gutter guard in place.

If it is desired for any reason to remove the gutter guard for obtaining access to the gutter trough, a suitable tool can quickly disengage the clip from the gutter return bead. FIG. 5 illustrates how a screw driver can be used for that purpose. The flat tip 70 of the screw driver 72 is positioned in the guide slot over the raised portion 56, with the tip of the head 70 engaging the upper surface of the clip. The clip is then forced downwardly so as to depress the upper edge of the projection 66 below the bottom edge of the return flange of the gutter return bead. The clip can then be gripped by the finger flange 64 and moved rearwardly out of the guide slot. Similar removal of all the longitudinally spaced clips conditions the gutter guard for upward movement away from its support on the gutter bead.

It will be apparent that although two projections 66 are shown in FIG. 6, the clip can be provided with a single such projection, or more than two. Obviously, a plurality of projections serve to accommodate substantial variation in gutter return bead construction, which varies substantially from gutter to gutter.

Figure 7:
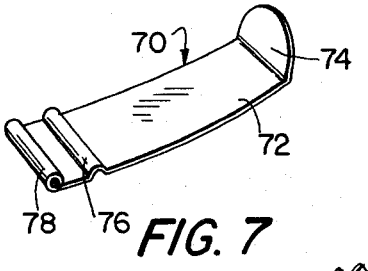

FIGS. 7–11 show other clip forms. Referring to FIG. 7, a clip generally indicated at 70 is illustrated, similarly being formed with a body portion 72 and a finger flange 74. Rather than being formed with struckup projections 66 as shown in FIG. 6, ribs 76 and 78 are provided which accomplish the same purpose. The clip 70 can be easily stamped, and is inserted in the guide slot for locking the gutter guard in the same manner as previously described.

Figure 8:
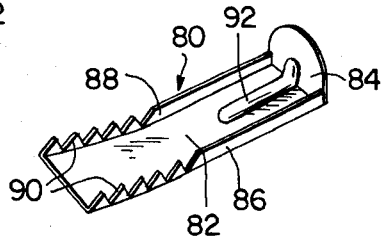

The locking clip generally indicated at 80 in FIG. 8 likewise includes a body portion 82 and a finger flange 84. Upwardly directed flanges 86 and 88 are provided at the sides of the body portion, with the forward ends of the flanges being serrated as commonly shown at 90. During use of the FIG. 8 clip, the leading edge of the clip is biased downwardly by the return bead flange as described, with the serrations being forced past the edge of the return bead until the clip has been properly positioned. The resilient nature of the clip, which is preferably formed of thin sheet metal, biases the leading end of the clip upwardly against the bottom edge of the gutter return bead thereby firmly engaging such edge against the bottom of the aligned serrated teeth with which said edge is in engagement. It will be noted that the leading end of the clip as shown in FIG. 8 is inclined slightly upwardly relative to the main body portion 82 of the clip, thereby enhancing the resilient pressure against the return bead flange when the clip is inserted through the guide slots for engagement with the flange edge. The clip 80 may be formed of desired width, with a rigidifying rib 92 formed in the main body of the clip before the finger flange 84 is struck upwardly. It will again be noted that the clip 80 can be formed simply and economically.

Figure 9:
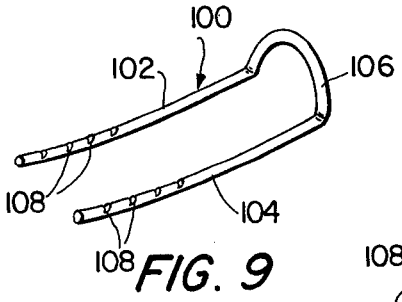

Referring to FIG. 9, there is illustrated therein a still further form of clip, generally indicated at 100. In this form, the clip is formed of metal wire reversely bent upon itself to form spaced legs 102 and 104, and a raised intermediate section 106, which corresponds to the finger flanges in the embodiments previously described. Each leg 102 and 104 has formed in the leading ends thereof a plurality of spaced grooves or notches commonly designated at 108. These correspond in function to the serrations 90 formed in the clip illustrated in FIG. 8, and in the use of the FIG. 9 clip, the clip is extended through the guide slot, and finally positioned so that the bottom edge of the reversely bent flange of the gutter return bead engages aligned grooves in each leg. As the clip 100 is inserted, such edge will sequentially engage each aligned pair of grooves, and the resilient nature of the spring clip will bias the legs upwardly so that the edge engages the aligned grooves. However, such resiliency is not sufficient to prevent continued forward movement of the clip until its proper position has been reached. As each pair of aligned grooves advances past the edge, the engagement of the bottom edge of the return flange with the grooves can be felt, thereby insuring that the final location of the clip is such that the flange edge engages one of the several pairs of aligned grooves illustrated in FIG. 9. Since the same resilient forces are encountered during the removal of the clip, the FIG. 9 form affords the further advantage of being removable without need for a special tool, thereby providing a temporary locking effect which can be quickly and easily engaged or disengaged with the return bead flange. As in FIG. 8, the leading ends of each leg 102 and 104 are preferably slightly upwardly inclined so as to enhance the resilient pressure afforded by the clip. It will be noted that the clip 100 can be easily formed by bending, with the notches or grooves being cut from the legs either before or after such bending operation.

Figure 10:
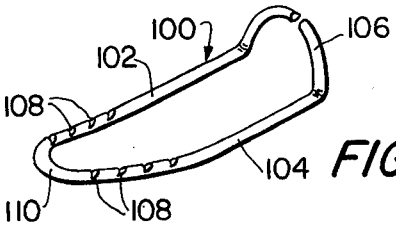

FIG. 10 is similar in many respects to FIG. 9, and the same reference numerals have been applied where appropriate. However, the FIG. 10 form is formed with a closed end 110, with the raised portion 106 of the clip by means of which the clip can be grasped comprising two separate, spaced end portions. In this manner, the clip can be similarly formed by a wire bending operation, with the ends of the clip being spaced at the end 106 of the clip rather than at the forward end between the legs 102 and 104 as shown in FIG. 9. Again, the leading ends of the legs are preferably slightly upwardly inclined to enhance the resilient detention of the clip, with the clip being installed and removed as previously described.

Figure 11:
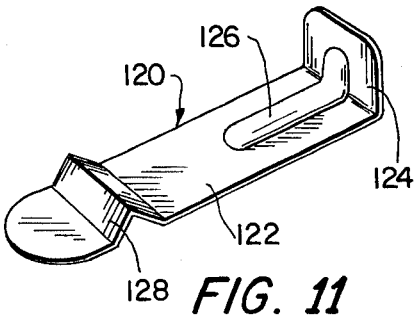

Referring to FIG. 11, a further form of clip is illustrated, generally indicated at 120. The clip includes a main body portion 122 and an upwardly directed finger flange 124, with an a stiffening bead 126 being formed in the body to facilitate the bending of the flange 124. A single upwardly extending projection 128 is formed in the clip, with the projection being generally triangular shape in cross section. Although only one such projection is shown in FIG. 11, it will be apparent that a plurality can be provided if desired. The leading edge of the projection 128 is upwardly and rearwardly inclined and thereby provides a cam surface when the clip is moved forwardly through the guide slot. Such camming effects downward movement of the leading edge of the clip, so as to position the projection 128 behind the edge of the return flange of the gutter return bead, thereby removably locking the clip, and thus the gutter guard to the gutter. The clip is again preferably formed of a relatively thin sheet metal material, inherently resilient when subjected to the downward movement resulting from the camming operation. Since the clip is retained by resilient forces behind the edge of the bead, it will be apparent that the clip can be removed from its temporarily locked position by simply retracting the clip without need for a separate tool.

Figure 12:
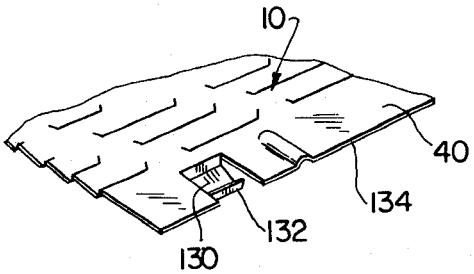
FIG. 12 illustrates a modified gutter guard construction formed with downwardly depending tongue portions formed with upwardly directed outer flanges which are adapted to extend behind the gutter return bead of the gutter.

A still further form of the invention is the provision of a gutter guard having integrally formed therewith at least one, and preferably a plurality of longitudinally spaced tongue members which inherently function as retaining clips when the gutter guard is mounted over the gutter. Reference is made to FIGS. 12 and 13, with the latter having been previously discussed with reference to the general configuration of the gutter and the gutter support braces positioned longitudinally along the gutter for support purposes. Referring to FIG. 12, a tongue 130 is struck downwardly from the plane of the guard 10, with the tongue being formed with an upwardly directed front flange 132. The flange is preferably slightly rearwardly inclined as shown in FIG. 13 so as to provide a cam surface which engages the reversely bent flange 24 of the gutter return bead shown in FIG. 13. As a result of such camming action, and in view of the inherent resiliency provided by the preferably sheet metal construction of the gutter guard, the flange 132 snaps into place behind the bottom edge of the return flange 24 of the gutter return bead, as shown in FIG. 13. The tongues 130 can be easily and inexpensively stamped from the gutter guard, and the FIG. 12 form of the invention avoids the use of a separate clip described above with reference to the other embodiments of the invention.

To removably lock the gutter guard of FIG. 12 in place, the guard is positioned over the gutter with the front edge 134 of the guard positioned adjacent the rearward edge of the gutter return bead. The guard is then moved forwardly whereby the leading edge 134 overlaps the top surface 22 of the gutter return bead, and the flanges 132 of the tongues 130 engage the flanges 24 of the gutter return bead. Continued movement serves to snap the flange 132 behind the return flange 24, as shown in FIG. 13, thereby retaining the gutter guard in place. To remove the guard, a screw driver or special key can be inserted into engagement with the tongue 130 and the tongue depressed, thereby lowering the top surface of the flange 132 below the edge of the return flange of the gutter return bead, thereby permitting the gutter guard to be removed rearwardly until the tongue clears the return flange, at which time the gutter guard can be raised upwardly and removed.

As above noted, a suitable tool can be used for disengaging the clip from the gutter return bead, with FIG. 5 illustrating a screw driver being used for that purpose. However, a screw driver has the disadvantage that bending of the raised portion 56 of the guide slots or the portion of the surface of the guard above the front end of the guide slot frequently results. Therefore, a tool specifically designed for permitting withdrawal of the clip has been designed, and is illustrated in FIGS. 14 and 15.

Figure 14:
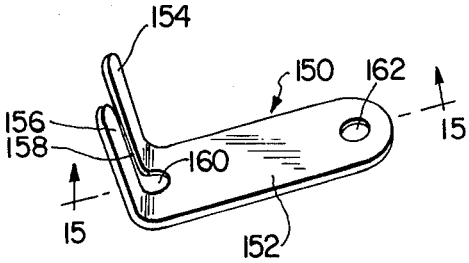
FIG. 14 is a perspective view of a release key for removing a locking snap dip.

The key is generally indicated at 150, and is shown in perspective view in FIG. 14. FIG. 15 comprises a sectional view taken along line 15—15 of FIG. 14. The key includes a main body portion 152 and a pair of leges 154 and 156 at the front of the key. The legs 154 and 156 preferably extend upwardly substantially perpendicular to the main body portion, although the legs could be angled to the main body portion to some degree if desired. The spaced legs define a slot 158 therebetween, and a generally semicircular slot 160 is rearwardly offset from the point at which the legs deviate from the plane of the main body. The purpose of the slot 160 will be presently described. A hole 162 is preferably formed in the rear portion of the body member to permit the key to be conveniently retained and hung when not in use.

Figure 15:
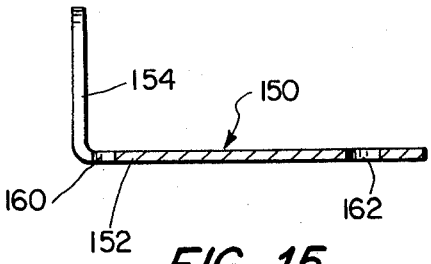

As can be seen in FIGS. 14 and 15, the leading edges of the legs 154 and 156 are swaged to form a more pointed and narrower front tip. This facilitates the rapid insertion of the key between the snap clip and the gutter bead edge, as will be presently described. The key 150 can be used with most if not all of the clip forms illustrated in FIGS. 6–12. For convenient reference, the use of the key with the clip form illustrated in FIGS. 2–6 will be described. As best seen in FIG. 2, the clip 60 in such form is provided with spaced projections 66, one of which engages behind the refersely bent flange 24 of the gutter return bead of the gutter. When it is desired to remove the clip from its locked position, the key is grasped by its body 152, with the legs 154 and 156 being inserted through the slot 54 toward the flange 24. The legs 154 and 156 of the key, when contacting the flange 24, will be forced downwardly, which in turn will cause downward movement of the leading end of the clip. The slot 158 is slightly greater in width than the width of the projection 66 whereby the legs can extend past the projections as the legs of the key are cammed downwardly by the flange 24. It will be noted that when the key is inserted for withdrawal of the clip, the legs 154 and 156 are generally parallel to the main body of the clip 60, with the body portion 152 of the key extending generally perpendicularly upwardly.

When the key is in its fully inserted position, the projections 66 are positioned below the bottom surface of the reversely bent flange 24 of the gutter return bead, whereby the clip can be quickly and easily removed from locking engagement with the gutter. An important feature of the invention is that the key can be maintained in its inserted position while the clip is being removed. This is possible due to the slot 158 and the slot 160 which provides an opening through which the projections 66 can pass during withdrawal of the clip, without interference with the key in its operative position. Thus the key can be inserted with one hand and the clip withdrawn with the other hand. This avoids the awkward and difficult procedure of removing both the key and the clip at the same time.

It will further be noted that the removal of the clip is toally without damage either to the clip or to the guide slot through which the clip extends. Thus, the clip can be reinserted if desired without the guide slot or clip suffering damage.

The key is used in the same manner with the other clip forms shown in FIGS. 7–12. In each instance, the key is inserted toward the reversely bent flange of the gutter bead and generally parallel to the plane of the body of the clip. The swaged and narrowed end portions of the key permit the leading edge of the key to extend below and beyond the flange 24 when the key continues to be moved forwardly. In this manner, the key legs serve to depress the forward or leading edge of the clip an amount sufficient to permit the projections or recesses by means of which the clip is retained to a extend below the bottom edge of the flange 24 whereby the clip can be removed.

It will thus be seen that a novel gutter guard has been provided, which performs the primary function of permitting rain to pass therethrough but precluding leaves and other debris from reaching the bottom of the gutter. In one form of the invention, tongue-like clips are provided integrally with the gutter guard for retaining the leading edge of the guard on the gutter return bead, and in other forms of the invention, a guide slot is stamped in the forward edge of the gutter guard at spaced intervals, and a separate clip is provided, preferably for each guide slot. The clips can be quickly and easily inserted in the guide slot and moved forwardly, with the clips being formed with projections or indentations which can be located behind or engaged by the bottom edge of the return flange of the gutter return bead. The gutter guards can thus be quickly and easily locked in place, and in all forms of the invention, the clips can be easily disengaged from the return flange to permit removal of the clip and guard from the gutter. A specially designed release key is provided for such purpose. The gutter guards can be inexpensively formed by stamping, and the clip embodiments, in all instances, can be formed inexpensively, in many instances from scrap metal.

I claim:

1. A gutter guard and locking snap clip for such guard for use with rain gutters in order to prevent leaves and other debris from clogging the outlet of the gutter, comprising (a) a gutter guard formed with louvre type slots to permit rain to pass therethrough to said gutter for runoff but prevent leaves or other debris from passing through said guard, said gutter having a gutter return bead with a top surface and a lower edge, said guard including a forward edge adapted to overlap and be supported by the top surface of the gutter return bead, said guard being formed with at least one guide groove adjacent said forward edge, said guide groove being located in a plane below the plane of the adjoining surfaces of said guard, said guard being formed with a raised member above a portion of said groove, said groove and said raised member defining an opening of predetermined height and width through which said clip can be inserted, said clip extending under said raised member and being held in said groove by said raised member, and (b) a locking snap clip for locking said guard to said gutter, said clip being smaller in width than said groove, said clip being formed with a leading end having at least one surface irregularity adjacent a plane of said leading end, said surface irregularity being adapted to cooperate with a reversely bent flange of said gutter return bead so as to removably lock said clip, and thus said guard, to said gutter.

2. The combination of claim 1 wherein said clip is formed with a main body portion, and upturned rear end flange which can be grasped during manipulation of a clip, and upwardly directed projections formed at the leading end of the clip which are adpated to extend behind the lower edge of the gutter return bead for locking the clip and thus the gutter guard to the gutter.

3. The combination of claim 2 wherein said projection means comprises a pair of spaced projections struck upwardly from said main body portion near the leading edge thereof, with said projections being rearwardly and upwardly inclined so as to provide cam surfaces engageable with the reversely bent flange of said gutter return beads and which snap behind such bead as said clip is moved forwardly, thereby locking said clip and gutter guards.

4. The combination of claim 2 wherein said projection means on said locking snap clip includes at least one upwardly extending projection which is bent or rolled from a body of said clip and extends transversely across the width of said clip, said at least one projection being formed with an upwardly and rearwardly directed surface by means of which the projection can be cammed downwardly below said reversely bent flange of said gutter return bead, and thereafter snapped behind said flange for locking said clip and said guard in place.

5. The combination of claim 1 wherein said locking snap clip comprises a bent wire having a pair of spaced legs and an upwardly bent rear end portion by means of said legs being formed with a plurality of notches or grooves, with the grooves in one leg being aligned with the grooves in the opposed leg, whereby the clip can be moved forwardly until the leading end of the clip engages the reversely bent flange of said gutter return bead after which such leading end of the clip is cammed downwardly, with an aligned pair of such grooves engaging an exposed bottom surface of reversely bent flange to retain such clip and said guard in place.

6. The gutter guard and locking snap clip of claim 1 wherein said clip comprises a main body portion and an upwardly turned finger flange formed at one end thereof, with edges of said main body portion being formed with upwardly turned flanges generally perpendicular to a plane of said main body portion, leading edges of said upwardly directed flanges being provided with serrations alternately providing peaks and valleys, with the peaks and valleys in each of said flanges being aligned, a leading end of said main body being slightly upwardly inclined whereby when said clip is positioned in said guide groove and moved forwardly, such leading end is cammed downwardly by said reversely bent flange of said gutter return bead whereby a pair of said aligned valleys of said serrations tightly engage a bottom edge of said reversely bent flange for retaining said clip and thus said gutter guard in place.

7. The combination of claim 1 wherein said gutter guard is formed with means for spacing said guard from front to rear on said gutter, said spacing means comprising a plurality of downwardly extending raised members struck from the forward edge of said guard, said reversely bent flange having a rearmost surface and said raised members, when said guard is positioned over said gutter, being positioned closely adjacent the rearwardmost surface of said reversely bent flange of said gutter return bead.

8. In combination with a gutter guard having a forward edge with at least one guide groove adjacent said forward edge, and a raised member above a portion of said guide groove, a locking snap clip for locking said gutter guard to a rain gutter, said clip extending through said raised member in said groove and being formed of resilient material and provided at a rear end with an upwardly extending portion which can be grasped for manipulation of the clip, said clip being further formed adjacent a leading end with at least one surface irregularity adjacent a plane of said leading end, said surface irregularity being adapted to cooperate with a surface of a gutter return bead on a gutter so as to removably lock the guard to said gutter, and wherein said surface irregularity comprises upwardly directed projections formed at the leading end of the clip which are adapted to extend behind a lower edge of a gutter return bead for locking the clip and thus the gutter guard to the gutter.

9. The combination of claim 8 wherein said projection means comprises a pair of spaced projections struck upwardly from a main body portion near a leading edge thereof, with said projections being rearwardly and upwardly inclined so as to provide cam surfaces engageable with a reversely bent flange of said gutter return bead and which can snap behind such bead as said clip is moved forwardly, thereby locking said clip and gutter guard.

* * * * *